US010377593B2

(12) United States Patent
Tatematsu

(10) Patent No.: US 10,377,593 B2
(45) Date of Patent: Aug. 13, 2019

(54) SHEET CONVEYING APPARATUS AND IMAGE FORMING APPARATUS

(71) Applicant: Brother Kogyo Kabushiki Kaisha, Nagoya-shi, Aichi-ken (JP)

(72) Inventor: Hirotaka Tatematsu, Nagoya (JP)

(73) Assignee: Brother Kyogo Kabushiki Kaisha, Nagoya-shi, Aichi-ken (JP)

( * ) Notice: Subject to any disclaimer, the term of this patent is extended or adjusted under 35 U.S.C. 154(b) by 35 days.

(21) Appl. No.: 15/715,912

(22) Filed: Sep. 26, 2017

(65) Prior Publication Data

US 2018/0086583 A1 Mar. 29, 2018

(30) Foreign Application Priority Data

Sep. 29, 2016 (JP) ..... 2016-192245

(51) Int. Cl.

| | |
|---|---|
| ***B65H 5/06*** | (2006.01) |
| ***B65H 29/12*** | (2006.01) |
| ***B41J 11/00*** | (2006.01) |
| ***B41J 13/00*** | (2006.01) |
| ***B41J 13/02*** | (2006.01) |

(52) U.S. Cl.

CPC ..... *B65H 5/062* (2013.01); *B41J 11/007* (2013.01); *B41J 13/0063* (2013.01); *B41J 13/025* (2013.01); *B65H 5/068* (2013.01); *B65H 29/125* (2013.01); *B65H 2402/46* (2013.01); *B65H 2404/1341* (2013.01); *B65H 2404/144* (2013.01); *B65H 2404/1431* (2013.01); *B65H 2404/174* (2013.01)

(58) Field of Classification Search

CPC ..... B65H 5/062; B65H 5/068; B65H 29/125; B65H 2404/142; B65H 2404/1422; B65H 2404/143; B65H 2404/1431; B65H 2404/144; B65H 2404/152; B65H 2404/174; B65H 2404/41

USPC ..... 271/274

See application file for complete search history.

(56) References Cited

U.S. PATENT DOCUMENTS 5,029,845 A * 7/1991 Simpson-Davis ..... B65H 7/12 271/262

6,219,505 B1 4/2001 Sato et al.

(Continued)

FOREIGN PATENT DOCUMENTS

JP 2002108153 A 4/2002

JP 2002316738 A 10/2002

(Continued)

*Primary Examiner* — David H Bollinger

(74) *Attorney, Agent, or Firm* — Banner & Witcoff, Ltd.

(57) ABSTRACT

A sheet conveying apparatus includes a conveying roller, a pinch roller, a holding member, and a pressing device. The pinch roller includes a roller shaft and a roller body rotatable relative to the roller shaft. The roller shaft includes a first end portion and a second end portion. The holding member holds the roller shaft movably in a first direction. The pressing device presses the roller shaft in a pressing direction such that the roller body is pressed against a peripheral surface of the conveying roller. The first end portion of the roller shaft has a first contact surface being a planar surface. The second end portion of the roller shaft has a second contact surface being a planar surface. The roller shaft is disposed such that the first contact surface and the second contact surface are oriented in the pressing direction.

12 Claims, 8 Drawing Sheets

(56) References Cited

U.S. PATENT DOCUMENTS

| | | | | |
|---|---|---|---|---|
| 7,149,456 | B2 | 12/2006 | Yamagata | |
| 8,543,051 | B2 | 9/2013 | Akatsuka et al. | |
| 2001/0028813 | A1 | 10/2001 | Nishimura et al. | |
| 2001/0031154 | A1 | 10/2001 | Sato et al. | |
| 2003/0049043 | A1 | 3/2003 | Fuwazaki et al. | |
| 2004/0175210 | A1* | 9/2004 | Otaka | B65H 5/062 399/318 |
| 2005/0201774 | A1 | 9/2005 | Yamagata | |
| 2007/0069456 | A1* | 3/2007 | Jeong | B65H 5/062 271/272 |
| 2011/0150553 | A1 | 6/2011 | Akatsuka et al. | |
| 2014/0210162 | A1* | 7/2014 | Imai | G03G 15/6529 271/274 |
| 2014/0306396 | A1* | 10/2014 | Lan | B65H 5/06 271/3.19 |
| 2016/0083208 | A1* | 3/2016 | Manor | F16M 13/02 271/274 |

FOREIGN PATENT DOCUMENTS

| | | | |
|---|---|---|---|
| JP | 2003081477 | A | 3/2003 |
| JP | 2003084638 | A | 3/2003 |
| JP | 2003267578 | A | 9/2003 |
| JP | 2004051332 | A | 2/2004 |
| JP | 2005255263 | A | 9/2005 |
| JP | 2008287173 | A | 11/2008 |
| JP | 2010-222107 | A | 10/2010 |
| JP | 2011131977 | A | 7/2011 |
| JP | 2014088259 | A | 5/2014 |

* cited by examiner

SHEET CONVEYING APPARATUS AND IMAGE FORMING APPARATUS

CROSS-REFERENCE TO RELATED APPLICATION

This application claims priority from Japanese Patent Application No. 2016-192245 filed on Sep. 29, 2016, the content of which is incorporated herein by reference in its entirety.

FIELD OF DISCLOSURE

Aspects disclosed herein relate to a sheet conveying apparatus for conveying a sheet and an image forming apparatus including the same.

BACKGROUND

A known image forming apparatus, such as a printer and a copier, includes a sheet conveying apparatus for conveying a recording sheet and an image forming device. The sheet conveying apparatus conveys a sheet along a conveyance path from a feed tray to a discharge tray. While the sheet is conveyed along the conveyance path, the image forming device forms an image on the sheet.

The sheet conveying apparatus includes a conveying roller and a pinch roller, which are paired with each other. The conveying roller is a drive roller and the pinch roller is a driven roller. The pinch roller is disposed such that its peripheral surface is in contact with the peripheral surface of the conveying roller. The pinch roller is pressed against the conveying roller by a pressing device. When a sheet enters between the conveying roller and the pinch roller, the conveying roller applies a conveying force to the sheet, and the sheet is conveyed by the conveying force.

Such a conveying force can be strengthened by increasing a force that the pressing device applies to the pinch roller, which may result in increased sheet conveying performance to convey a relatively thick sheet appropriately.

SUMMARY

Illustrative aspects of the disclosure provide a sheet conveying apparatus in which a roller body of a pinch roller is pressed against a conveying roller with sufficient force, and provide an image forming apparatus including such a sheet conveying apparatus.

According to an aspect of the disclosure, a sheet conveying apparatus includes a conveying roller, a pinch roller, a holding member, and a pressing device. The pinch roller includes a roller shaft and a roller body. The roller shaft extends parallel to a rotation axis of the conveying roller. The roller shaft includes a first end portion and a second end portion opposite to the first end portion. The roller body is supported by the roller shaft and rotatable relative to the roller shaft. The holding member has a first groove receiving the first end portion of the roller shaft and a second groove receiving the second end portion of the roller shaft. The first groove and the second groove extend in a first direction orthogonal to the roller shaft. The holding member holds the roller shaft movably in the first direction. The pressing device presses the roller shaft in a pressing direction parallel to the first direction and directed toward the conveying roller such that the roller body is pressed against a peripheral surface of the conveying roller. The first end portion of the roller shaft has a first contact surface at a peripheral surface of the first end portion, the first contact surface being a planar surface. The second end portion of the roller shaft has a second contact surface at a peripheral surface of the second end portion, the second contact surface being a planar surface. The roller shaft is disposed such that the first contact surface and the second contact surface are oriented in the pressing direction.

This configuration may provide a sufficient interval between each of the first contact surface and the second contact surface of the roller shaft and an end of a corresponding one of the first groove and the second groove of the holding member in the pressing direction. Therefore, although the roller body of the pinch roller has a relatively small outside diameter, such a configuration may enable the roller body to be pressed against the peripheral surface of the conveying roller.

According to another aspect of the disclosure, an image forming apparatus includes an image forming device configured to form an image on a sheet, and a sheet conveying device configured to convey a sheet toward the image forming device. The sheet conveying device includes a conveying roller, a pinch roller, a holding member, and a pressing device. The pinch roller includes a roller shaft and a roller body. The roller shaft extends parallel to a rotation axis of the conveying roller. The roller shaft includes a first end portion and a second end portion opposite to the first end portion. The roller body is supported by the roller shaft and rotatable relative to the roller shaft. The holding member has a first groove receiving the first end portion of the roller shaft and a second groove receiving the second end portion of the roller shaft. The first groove and the second groove extend in a first direction orthogonal to the roller shaft. The holding member holds the roller shaft movably in the first direction. The pressing device presses the roller shaft in a pressing direction parallel to the first direction and directed toward the conveying roller such that the roller body is pressed against a peripheral surface of the conveying roller. The first end portion of the roller shaft has a first contact surface at a peripheral surface of the first end portion, the first contact surface being a planar surface. The second end portion of the roller shaft has a second contact surface at a peripheral surface of the second end portion, the second contact surface being a planar surface. The roller shaft is disposed such that the first contact surface and the second contact surface are oriented in the pressing direction.

With this configuration, effects similar to those brought about by the above-described sheet feeding apparatus can be appreciated.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

An illustrative embodiment will be described with reference to the accompanying drawings.

<Overall Configuration>

Figure 1:
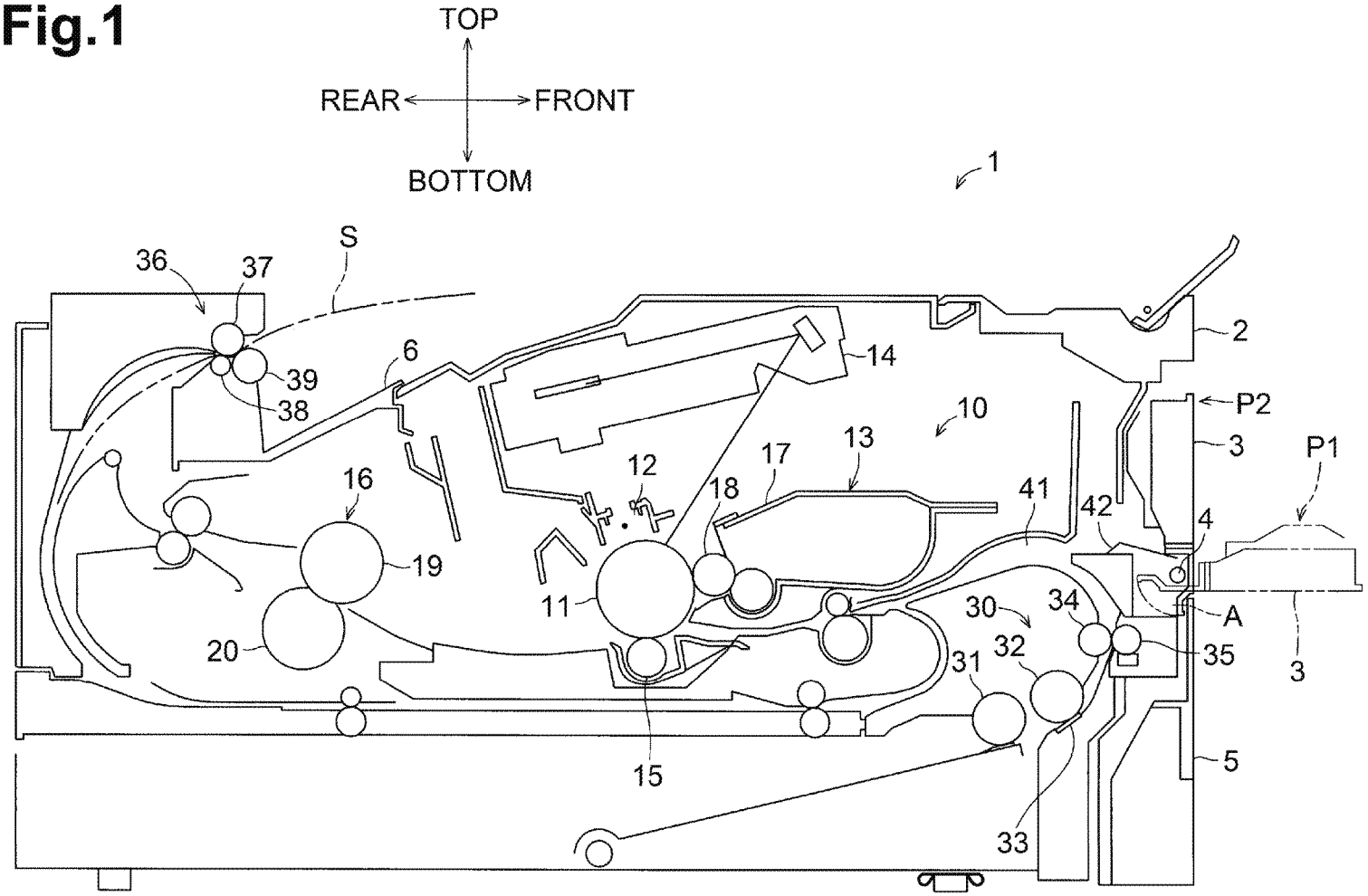
FIG. 1 is a schematic cross-sectional view of a laser printer in an illustrative embodiment according to one or more aspects of the disclosure.

A laser printer 1 (as an example of an image forming apparatus) illustrated in FIG. 1 may be a monochrome laser printer. The laser printer 1 includes a casing 2 (as an example of a casing).

Figure 2:
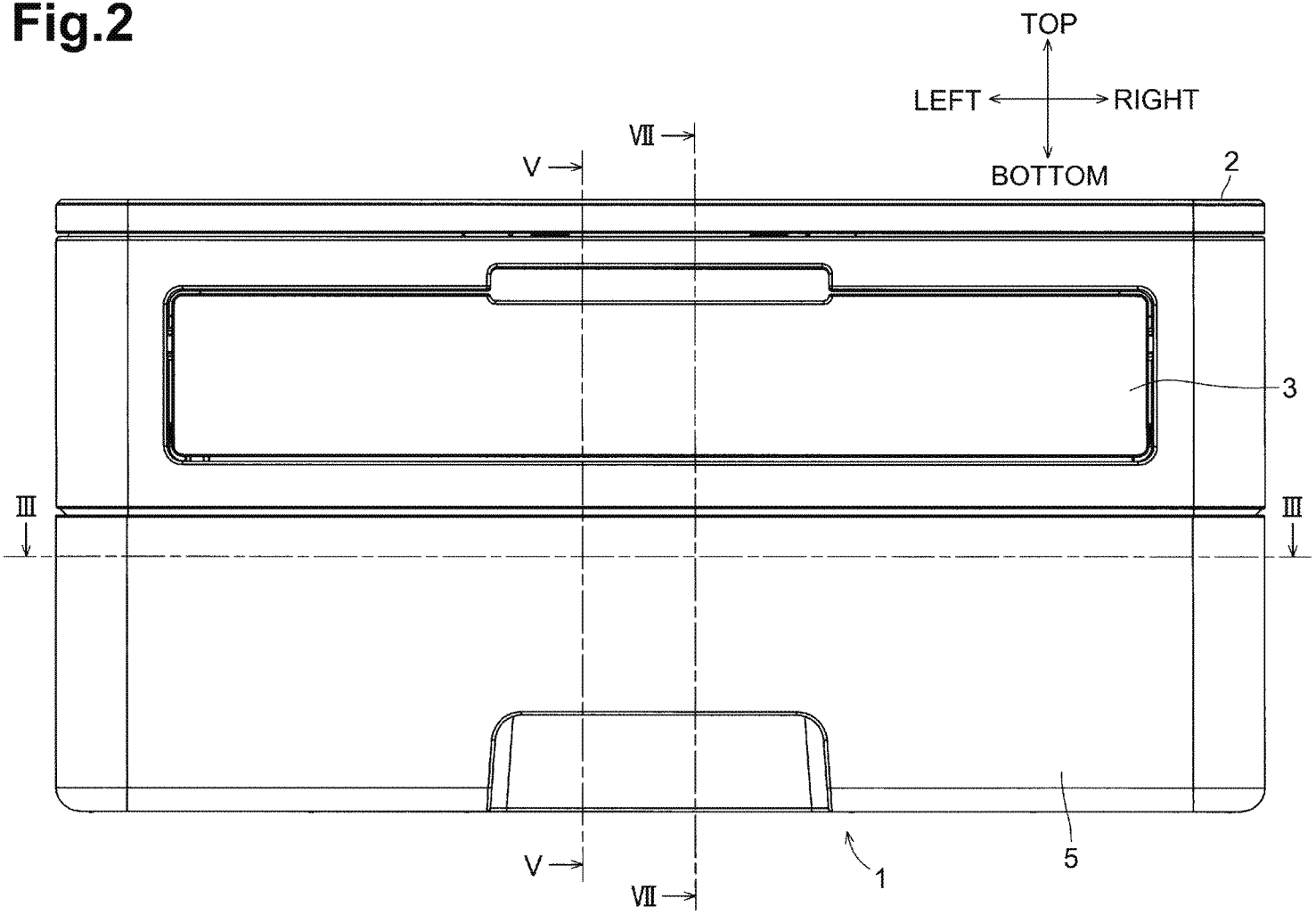
FIG. 2 is a front view of the laser printer in the illustrative embodiment according to one or more aspects of the disclosure.

As illustrated in FIGS. 1 and 2, the casing 2 has a substantially rectangular parallelepiped shape and includes a front cover 3 (as an example of an openable cover) at one of sides of the casing 2, i.e. a front side of the casing 2. The front cover 3 has an outer surface that may constitute a portion of an exterior surface of the casing 2. The front cover 3 is pivotable between an open position P1 and a closed position P2 on a pivot shaft 4 that is rotatably supported by the casing 2. When the front cover 3 is located at the open position P1, the front cover 3 is angled relative to the front side of the casing 2 (e.g., the front cover 3 may extend substantially horizontally relative to the front side of the casing 2). When the front cover 3 is located at the closed position P2, the front cover 3 extends along the front side of the casing 2, more specifically, it is situated such that its outer surface may extend substantially evenly with the other portion of the exterior surface of the casing 2 at the front side of the casing 2.

In the following description, a side of the laser printer 1, in which the front cover 3 may be provided, may be defined as the front of the laser printer 1 and its opposite side is defined as the rear of the laser printer 1. As illustrated in FIG. 1, the top and bottom may be defined with reference to an orientation of the laser printer 1 that may be disposed in an orientation in which it may be intended to be used. The right and left may be defined with respect to the laser printer 1 as viewed from the front of the laser printer 1. The defined directions may be applicable to all the drawings.

The casing 2 includes a feed tray 5 (as an example of a tray) at its bottom. More specifically, for example, the feed tray 5 is located at an installed position so as to be detachable from the bottom of the casing 2 by drawing toward the front. The detached feed tray 5 is enabled to be attached to the bottom of the casing 2 (e.g., the installed position) by insertion into the casing 2. The feed tray 5 is configured to support one or more sheets S in a stacked manner.

The casing 2 further includes a discharge tray 6 at its upper exterior surface. The discharge tray 6 defines a portion of the upper exterior surface of the casing 2.

The laser printer 1 further includes an image forming device 10 within the casing 2.

The image forming device 10 includes a photosensitive drum 11, a charger 12, a developing device 13, an exposure device 14, a transfer roller 15, and a fixing device 16.

The photosensitive drum 11 is rotatable about an axis extending in a right-left direction, which may correspond to a width direction of the laser printer 1.

The charger 12 is disposed diagonally above the photosensitive drum 11 and is offset to the rear relative to the photosensitive drum 11. The charger 12 may be, for example, a scorotron charger including a wire and a grid.

The developing device 13 is disposed in front of the photosensitive drum 11. The developing device 13 includes a housing 17 and a developing roller 18. The housing 17 stores toner therein. The developing roller 18 is supported by the housing 17. The developing roller 18 is rotatable about an axis extending in the right-left direction. The developing roller 18 has a peripheral surface, which is in contact with a peripheral surface of the photosensitive drum 11.

The exposure device 14 is disposed above the photosensitive drum 11, the charger 12, and the developing device 13. The exposure device 14 includes a laser beam source an optical system including lenses and a polygon mirror. The exposure device 14 is configured to emit a laser beam to the peripheral surface of the photosensitive drum 11 based on image data.

The transfer roller 15 is disposed below the photosensitive drum 11. The transfer roller 15 is rotatable about an axis extending in the right-left direction.

The fixing device 16 is disposed behind the charger 12. The fixing device 16 includes a heat roller 19 and a pressure roller 20. The heat roller 19 is rotatable about an axis extending in the right-left direction. The pressure roller 20 is also rotatable about an axis extending in the right-left direction. A lower rear portion of a peripheral surface of the heat roller 19 is in contact with an upper front portion of peripheral surface of the pressure roller 20.

The laser printer 1 further includes a conveying device 30 (as an example of each of a sheet conveying device and a sheet conveying apparatus) for conveying a sheet S. The conveying device 30 includes a feed roller 31, a separation roller 32, a separation pad 33, a conveying roller 34, a pinch roller 35, and a discharge roller unit 36. The feed roller 31, the separation roller 32, the conveying roller 34, the pinch roller 35, and the discharge roller unit 36 are disposed at the casing 2. The separation pad 33 is disposed at the feed tray 5.

The feed roller 31 is disposed above a front end portion of the feed tray 5 and is rotatable about an axis extending in the right-left direction. In a state where the feed tray 5 is located at the installed position in the casing 2, a peripheral surface of the feed roller 31 is in contact with a topmost one of one or more sheets S accommodated in the feed tray 5.

The separation roller 32 is disposed in front of the feed roller 31 and is rotatable about an axis extending in the right-left direction.

In a state where the feed tray 5 is located at the installed position in the casing 2, the separation pad 33 is in contact with a peripheral surface of the separation roller 32.

The conveying roller 34 is disposed diagonally above the separation roller 32 and is offset to the front relative to the separation roller 32. The conveying roller 34 is rotatable about an axis extending in the right-left direction.

The pinch roller 35 is disposed in front of the conveying roller 34 and outside an area A in which one (e.g., a lower end) of ends of the front cover 3 moves when the front cover 3 is opened or closed. The pinch roller 35 is rotatable about an axis extending in the right-left direction. The pinch roller 35 has a peripheral surface, which is in contact with a peripheral surface of the conveying roller 34.

The discharge roller unit 36 is disposed above the fixing device 16 and faces the discharge tray 6 from the rear. The discharge roller unit 36 includes a drive roller 37 and a pair of driven rollers 38 and 39. The drive roller 37 and the driven rollers 38 and 39 are in contact with each other via their peripheral surfaces. Each of the drive roller 37 and the driven rollers 38 and 39 is rotatable about a respective axis extending in the right-left direction.

In printing (i.e., in image formation), the image forming device 10 and the conveying device 30 perform image formation and sheet conveyance, respectively.

The feed roller 31 rotates counterclockwise in order to feed a sheet S from the feed tray 5 when viewed from the left. With the rotation of the feed roller 31, a sheet S contacting the peripheral surface of the feed roller 31 (i.e., the topmost sheet S of the one or more sheets S accommodated in the feed tray 5) is fed forward. The sheet S fed from the feed tray 5 is then separated from the one or more other sheets S when the fed sheet S passes through between the separation roller 32 and the separation pad 33.

The sheet S passed through between the separation roller 32 and the separation pad 33 is conveyed along a conveyance path 41 having a substantially S shape when viewed from the right or the left. More specifically, for example, the sheet S passes through between the conveying roller 34 and the pinch roller 35 while being pinched therebetween. Then, the sheet S passes through between the photosensitive drum 11 and the transfer roller 15, between the heat roller 19 and the pressure roller 20 of the fixing device 16, and between the drive roller 37 and the pair of driven rollers 38 and 39 in this order.

The photosensitive drum 11 rotates clockwise when viewed from the left. With the rotation of the photosensitive drum 11, the peripheral surface of the photosensitive drum 11 is uniformly charged by the charger 12 and is then exposed selectively with a laser beam emitted from the exposure device 14. With the exposure, electrostatic charges generated on the peripheral surface of the photosensitive drum 11 are selectively removed therefrom. Thus, an electrostatic latent image is formed on the peripheral surface of the photosensitive drum 11. When the electrostatic latent image faces the developing roller 18, toner moves onto the electrostatic latent image from the developing roller 18 due to potential difference between the electrostatic latent image and the developing roller 18. Therefore, the electrostatic latent image is developed to a toner image on the peripheral surface of the photosensitive drum 11.

The image forming device 10 and the conveying device 30 are controlled to perform image formation and sheet conveyance, respectively, in synchronization with each other, such that the fed sheet S is positioned between the photosensitive drum 11 and the transfer roller 15 when the toner image faces the transfer roller 15 via the sheet S. The transfer roller 15 is configured to be applied with a transfer bias. Therefore, when the sheet S passes through between the photosensitive drum 11 and the transfer roller 15, the toner image is transferred onto an upwardly-facing surface of the sheet S from the peripheral surface of the photosensitive drum 11 by application of the transfer bias to the transfer roller 15. The sheet S on which the toner image has been transferred is further conveyed to the fixing device 16. In the fixing device 16, the sheet S passes through between the heat roller 19 and the pressure roller 20. Meanwhile, the toner image is fixed onto the sheet S by heat and pressure. As a result, an image is formed on the sheet S. The sheet S on which the image has been formed is then discharged onto the discharge tray 6 by the discharge roller unit 36.

Figure 3:
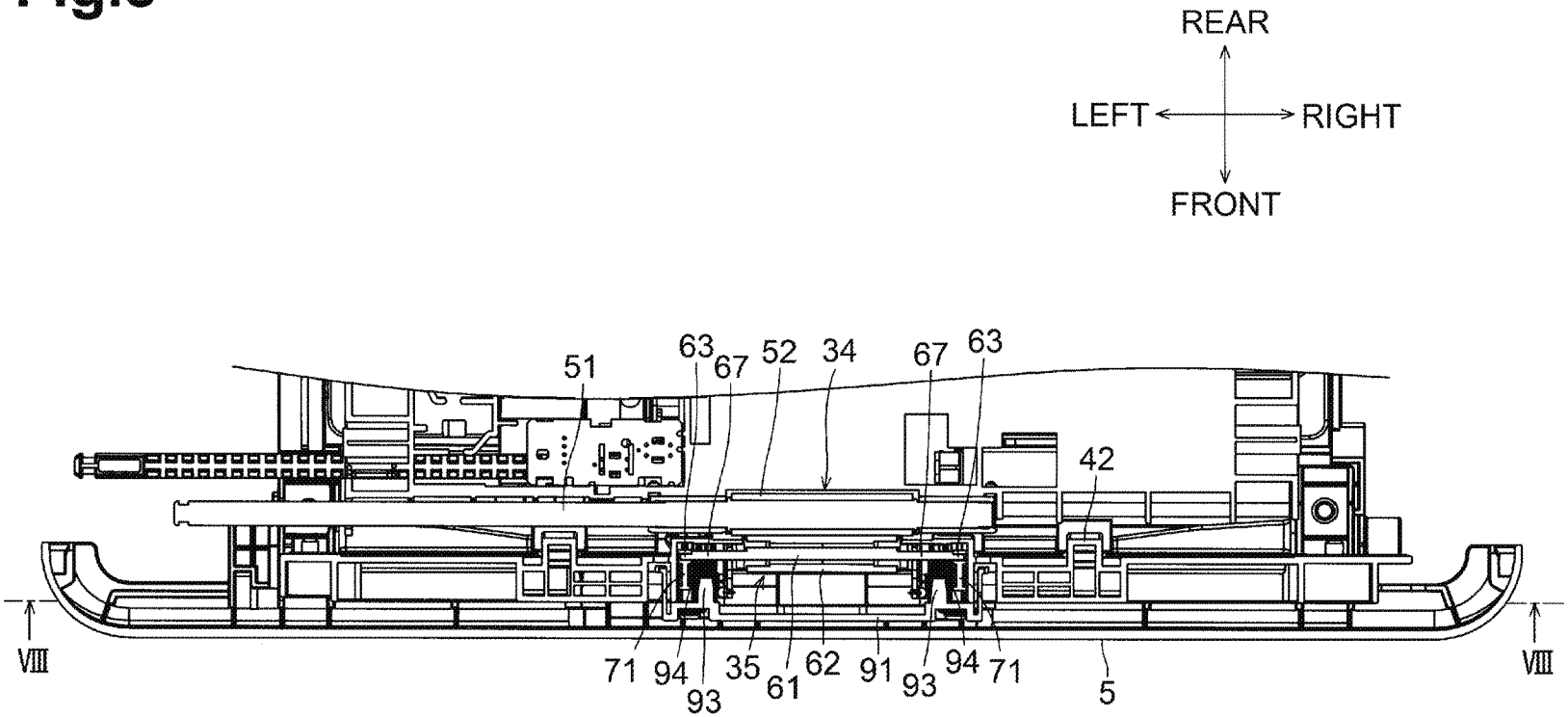
FIG. 3 is a cross-sectional view of the laser printer taken along line of FIG. 2 in the illustrative embodiment according to one or more aspects of the disclosure.

As illustrated in FIG. 3, a frame 42 (as an example of a holding member) is disposed in the casing 2 (refer to FIG. 2). The frame 42 may be made of, for example, resin or plastic.

<Conveying Roller>

As illustrated in FIG. 3, the conveying roller 34 includes a conveying roller shaft 51 and a conveying roller body 52 that is fit around the conveying roller shaft 51.

The conveying roller shaft 51 is rotatably supported by the frame 42. The conveying roller shaft 51 extends between a central portion and a left end portion of the casing 2 in the right-left direction.

The conveying roller body 52 has a hollow cylindrical shape and is disposed around an outer peripheral surface of the conveying roller shaft 51. The conveying roller body 52 is fixed to a right end portion of the conveying roller shaft 51 so as not to rotate relative to the conveying roller shaft 51.

A gear (not illustrated) is fixedly attached to a left end portion of the conveying roller shaft 51. The gear is configured to receive power transmitted from a motor (not depicted) disposed in the casing 2. The conveying roller 34 is configured to rotate about the conveying roller shaft 51 driven by the power transmitted to the gear.

<Pinch Roller>

The pinch roller 35 includes a pinch roller shaft 61 (as an example of a roller shaft) and a pinch roller body 62 (as an example of a roller body). The pinch roller shaft 61 extends in a direction parallel to an axis of the conveying roller 34, e.g., the right-left direction. The pinch roller body 62 is fit around the pinch roller shaft 61.

Figure 4:
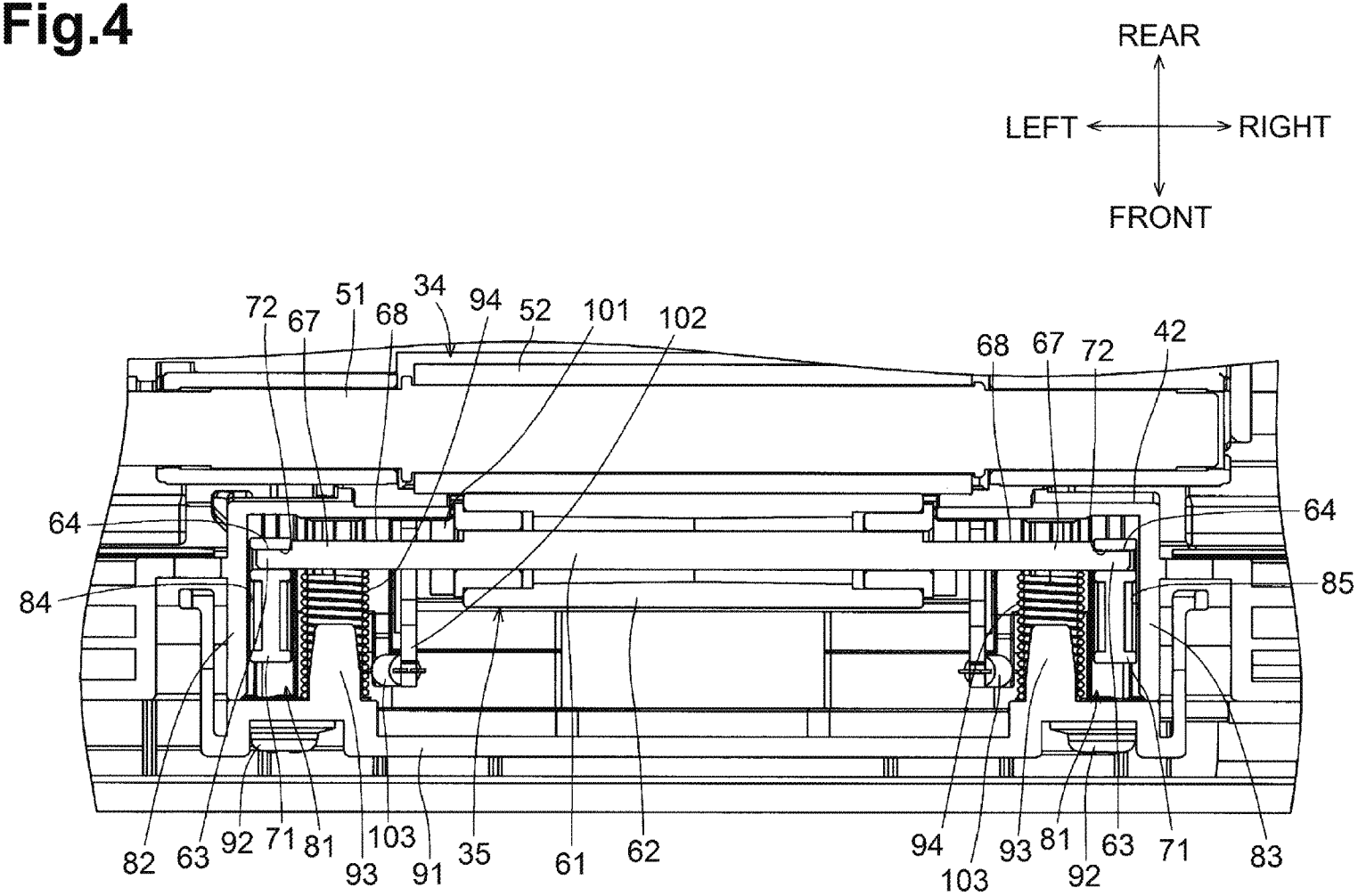
FIG. 4 is an enlarged view of a portion of the cross-sectional view of FIG. 3 in the illustrative embodiment according to one or more aspects of the disclosure.
Figure 5:
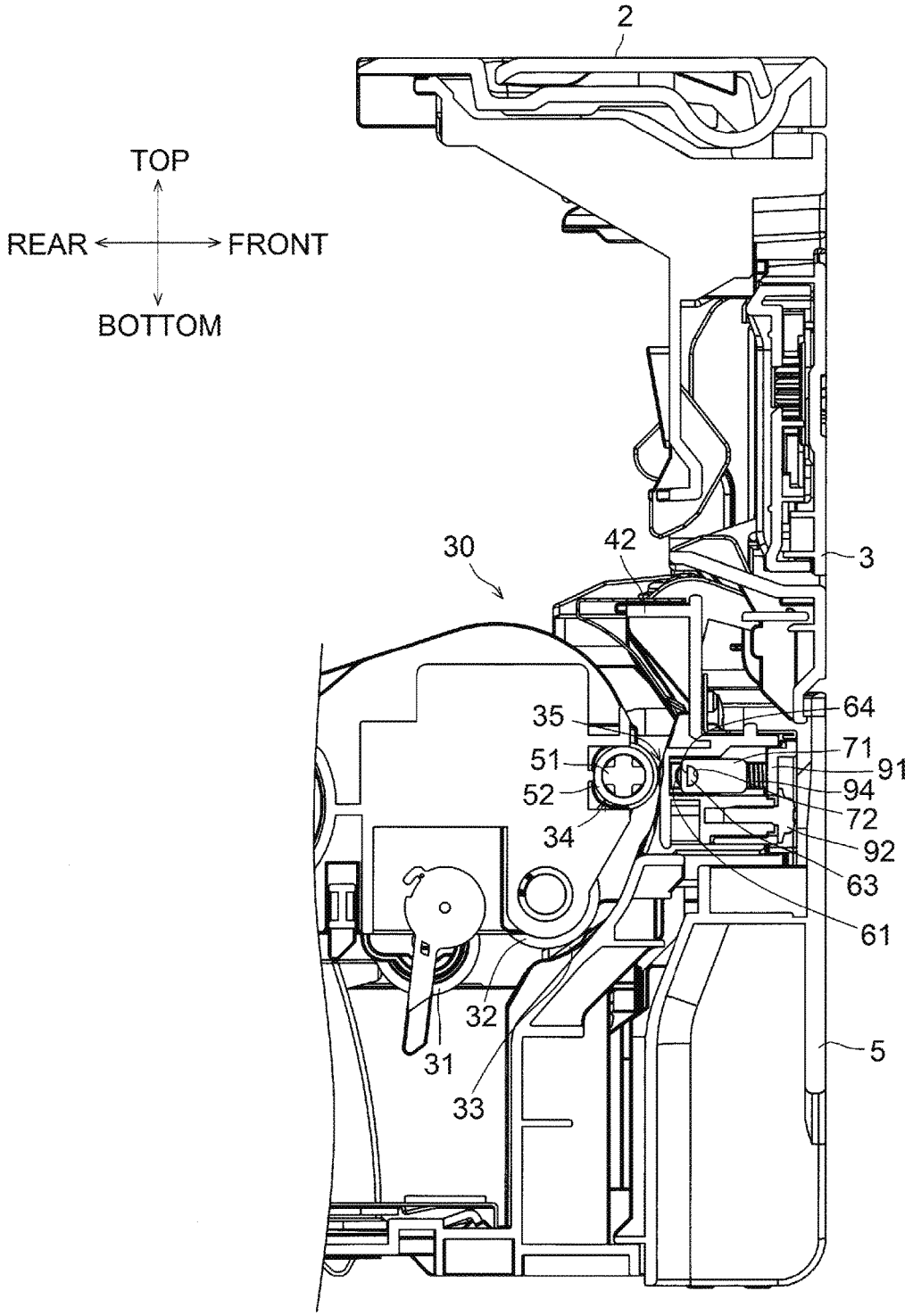
FIG. 5 illustrates a portion of a cross-sectional view of the laser printer taken along line V-V of FIG. 2 in the illustrative embodiment according to one or more aspects of the disclosure.
Figure 6:
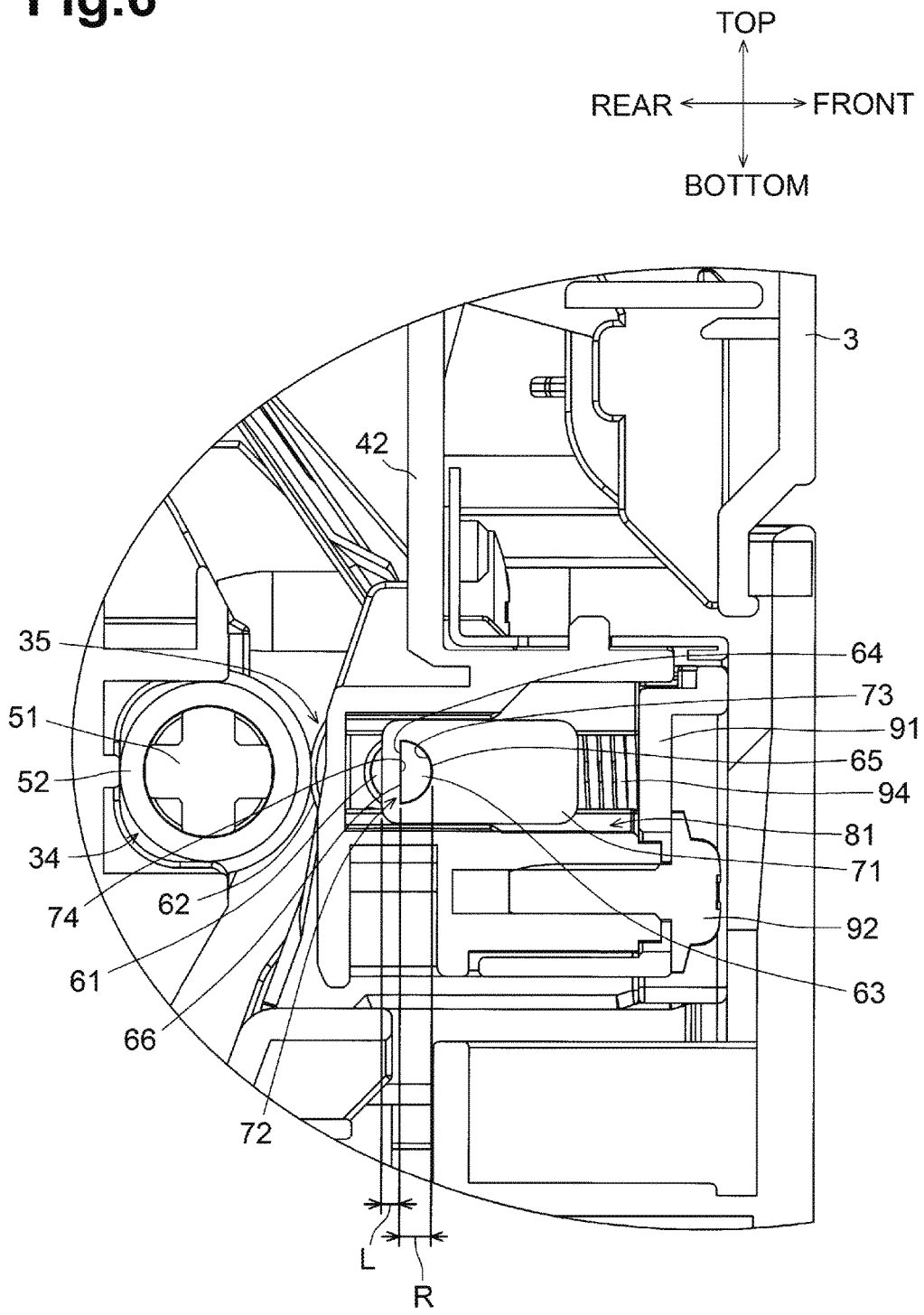
FIG. 6 is an enlarged view of a portion of the cross-sectional view of FIG. 5 in the illustrative embodiment according to one or more aspects of the disclosure.

The pinch roller shaft 61 may be made of, for example, metal, and has a cylindrical shape. As illustrated in FIGS. 4, 5, and 6, the pinch roller shaft 61 has a contact surface 64, which may be a planar surface, at its peripheral surface at each of end portions 63. More specifically, for example, as illustrated in FIG. 6, the left end portion 63 of the pinch roller shaft 61 has undergone D cutting and has an arc- or semicircular-shaped (i.e., a D-shaped) end face, which consists of an arc 65 and a chord 66 subtending the arc 65. The contact surface 64 of the left end portion 63 of the roller shaft 61 is a planar surface including a chord 66 of a D-shaped left end face at the left end. The contact surface 64 of the right end portion 63 of the roller shaft 61 is a planar surface including a chord 66 of a D-shaped right end face at the right end. The chord 66 of each D-shaped end face corresponds to a diameter of the pinch roller shaft 61. Thus, the contact surface 64 includes the rotation axis of the pinch roller 35.

As illustrated in FIG. 4, the pinch roller shaft 61 further includes pressed portions 67 between the end portions 63 in the right-left direction. More specifically, for example, the left pressed portion 67 is adjacent to and to the right of the left end portion 63, and the right pressed portion 67 is adjacent to and to the left of the right end portion 63. Each of the pressed portions 67 has a planar surface 68 at its peripheral surface. The pinch roller shaft 61 has the planar surfaces 68 further to the rear than the contact surfaces 64. In other words, each of the pressed portions 67 of the pinch roller shaft 61 has undergone D cutting and has an arc-shaped (i.e., a D-shaped) cross section, which consists of an arc and a chord subtending the arc.

The end portions 63 of the pinch roller shaft 61 are held by respective sliders 71 disposed at the frame 42. Each of the sliders 71 has, in its rear end portion, a hole 72 for receiving and engaging with a corresponding one of the end portions 63 of the pinch roller shaft 61. The end portions 63 of the pinch roller shaft 61 are engaged with the respective holes 72 of the sliders 71 by insertion so as not to rotate relative to the sliders 71. Each of the sliders 71 may be made of, for example, resin or plastic, and has a substantially rectangular shape extending in the front-rear direction in side view and plan view. Each of the holes 72 has a shape corresponding to the arc- or D-shaped end portion 63 of the pinch roller shaft 61. More specifically, as illustrated in FIG. 6, each of the holes 72 of the sliders 71 has an arc- or semicircular-shape (i.e., a D-shape), which consists of an arc 73 and a chord 74 subtending the arc 73. The chord 74 is located at the rear of the arc 73. While the sliders 71 are disposed at the frame 42 such that the chords 74 of the holes 72 are oriented toward the rear, the left end portion 63 of the pinch roller shaft 61 is engaged with the hole 72 of the left slider 71 by insertion from the right of the left slider 71, and the right end portion 63 of the pinch roller shaft 61 is engaged with the hole 72 of the right slider 71 by insertion from the left of the right slider 71. Therefore, the pinch roller shaft 61 is disposed such that the contact surfaces 64 are oriented to the rear.

As illustrated in FIG. 6, in each of the sliders 71 (only one of which is illustrated in FIG. 6), the hole 72 is positioned such that a distance L, which may be an interval between the chord 74 and a rear end of the slider 71 in the front-rear direction, is shorter than a radius R of the pinch roller shaft 61. In other words, the pinch roller shaft 61 has the radius R that is greater than the distance L in the state where the end portions 63 of the pinch roller shaft 61 are engaged with the respective holes 72.

As illustrated in FIG. 4, the sliders 71 are disposed in respective grooves 81 defined in the frame 42. The grooves 81 extend in the front-rear direction and enable the respective sliders 71 to slide in the front-rear direction along the respective grooves 81. The frame 42 has a first restriction wall 82 and a second restriction wall 83. The first restriction wall 82 is positioned to the left of the left groove 81. The second restriction wall 82 is positioned to the right of the right groove 81. The first restriction wall 82 has a first restriction surface 84, which may be a right surface of the first restriction wall 82. The second restriction wall 83 has a second restriction surface 85, which may be a left surface of the second restriction wall 83. The first restriction surface 84 and the second restriction surface 85 may be planar surfaces extending in the front-rear direction. With this configuration, the first restriction surface 84 faces the left slider 71 from the left, and the second restriction surface 85 faces the right slider 71 from the right while extending parallel to the first restriction surface 84.

The pinch roller body 62 is fit around the pinch roller shaft 61 and is positioned between the pressed portions 67 in the right-left direction. The pinch roller body 62 is supported by the pinch roller shaft 61 so as to rotate relative to the pinch roller shaft 61. The pinch roller body 62 has a dimension (e.g., a length) shorter than the conveying roller body 52 in the right-left direction. The pinch roller body 62 is in contact with a middle portion of the conveying roller body 52 in the right-left direction.

A plate 91 is attached to the front end of the frame 42 with a plurality of, for example, two bolts 92. The plate 91 has a length in the right-left direction to face all of the pinch roller 35 and the right and left sliders 71 from the front. The plate 91 includes substantially cylindrical spring support protrusions 93 on its rear surface. The spring support protrusions 93 protrude toward the rear from the rear surface at respective positions at which the spring support protrusions 93 face the corresponding pressed portions 67 of the pinch roller shaft 61.

A coil spring 94 (as an example of a pressing member) is fit around each of the spring support protrusions 93. In each of the coil springs 94, one end (e.g., a front end) is in contact with the rear surface of the plate 91 and the other end (e.g., a rear end) is in contact with a corresponding pressed portion 67 of the pinch roller shaft 61 from the front. In such a state, the coil springs 94 are held between the plate 91 and the respective pressed portions 67 with being compressed. With this configuration, the pressed portions 67 of the pinch roller shaft 61 are elastically pressed toward the rear by the respective coil springs 94. Further, the pressing force of each of the coil springs 94 enables the pinch roller body 62 of the pinch roller 35 to contact the conveying roller body 52 of the conveying roller 34 elastically from the front.

<Paper Dust Remover>

Figure 7:
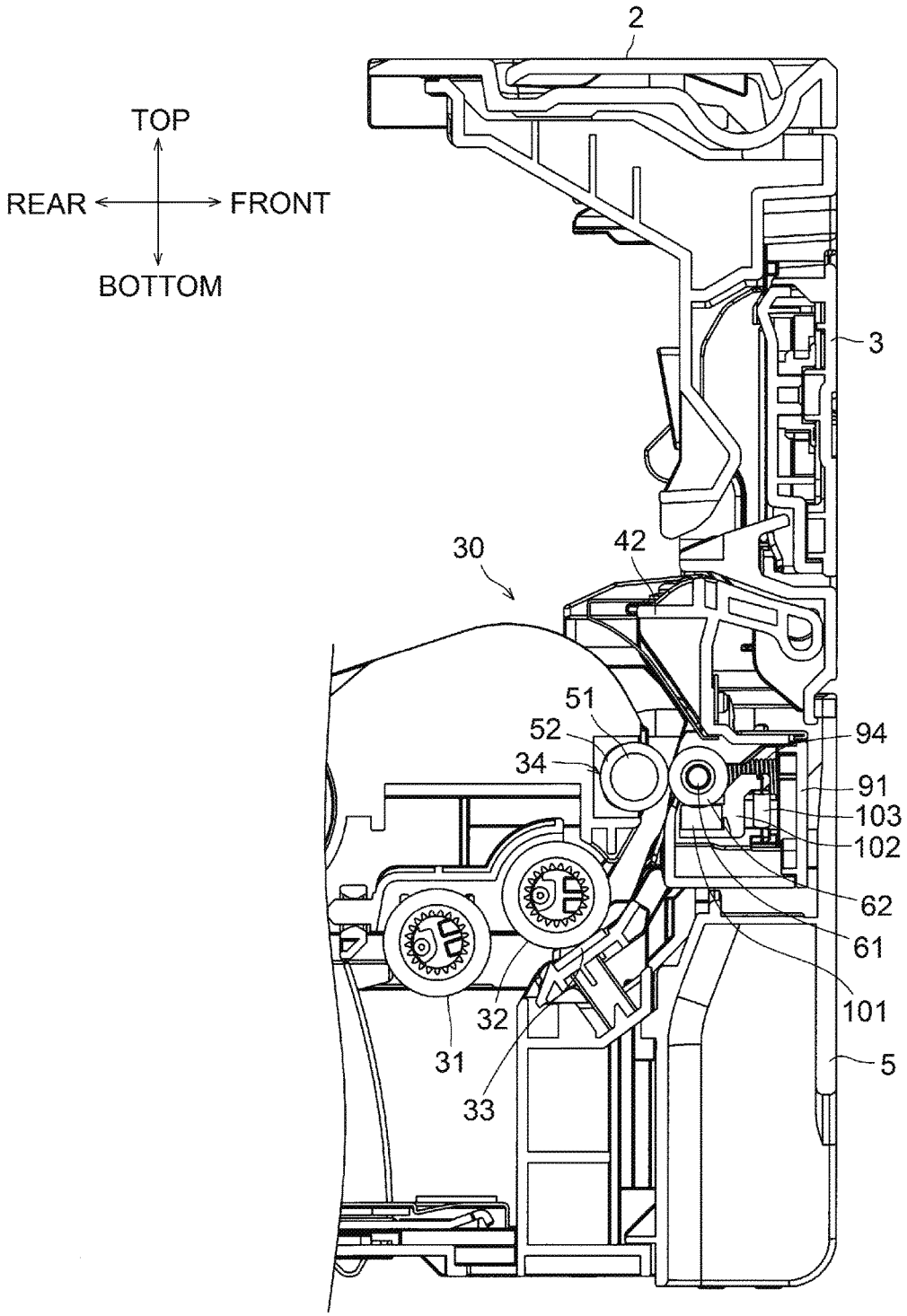
FIG. 7 illustrates a portion of a cross-sectional view of the laser printer taken along line VIII-VIII of FIG. 2 in the illustrative embodiment according to one or more aspects of the disclosure.
Figure 8:
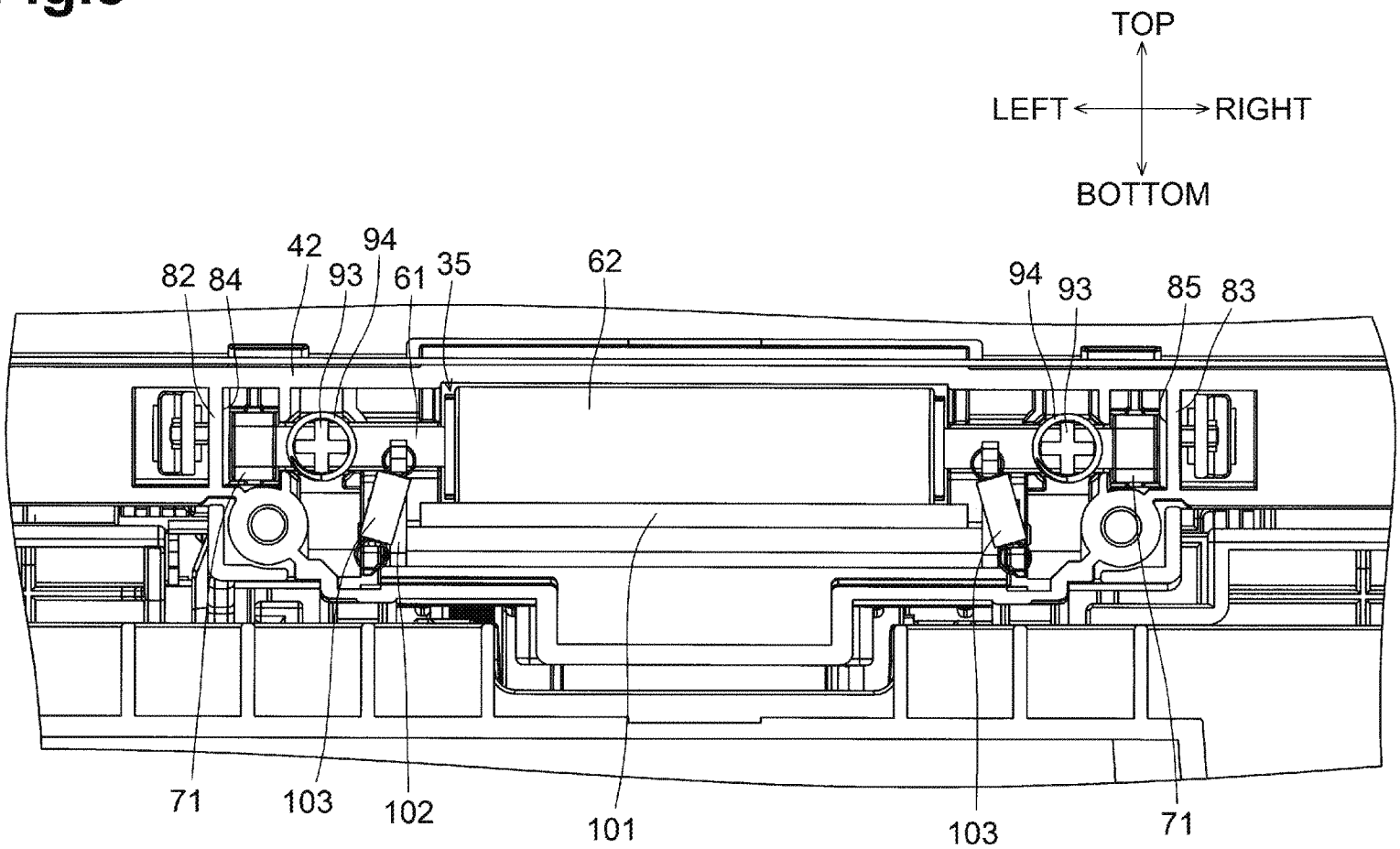
FIG. 8 illustrates an enlarged view of a portion of the cross sectional view of the laser printer taken along line VIII-VIII of FIG. 3 in the illustrative embodiment according to one or more aspects of the disclosure.

As illustrated in FIGS. 7 and 8, a paper dust remover 101 is disposed below the pinch roller body 61. The paper dust remover 101 may be a sponge. As illustrated in FIG. 8, the paper dust remover 101 has a substantially rectangular parallelepiped shape. The paper dust remover 101 is longer than the pinch roller body 62 in the right-left direction. The paper dust remover 101 is held by a holder 102 while being in contact with an entire portion of the peripheral surface of the pinch roller body 62 in the right-left direction by urging force of a plurality of, for example, two coil springs 103.

When a sheet S passes between the conveying roller 34 and the pinch roller 35, paper dust adhering to the sheet S may transfer and adhere to the peripheral surface of the pinch roller 35. Thereafter, when paper dust adhering to the peripheral surface of the pinch roller 35 faces and contacts the paper dust remover 101 with rotation of the pinch roller 35, the paper dust is removed from the peripheral surface of the pinch roller 35.

<Effects>

The pinch roller 35 includes the pinch roller shaft 61 and the pinch roller body 62. The pinch roller shaft 61 extends parallel to the axis of the conveying roller 34. The pinch roller body 62 is supported rotatably relative to the pinch roller shaft 61. The frame 42 has the grooves 81 at the respective positions corresponding to the end portions 63 of the pinch roller shaft 61. The grooves 81 both extend in the front-rear direction orthogonal to the right-left direction which may be the axial direction of the pinch roller shaft 61. The sliders 71 are disposed in the respective grooves 81 of the frame 42 so as to be movable in the front-rear direction. The end portions 63 of the pinch roller shaft 61 are held by the respective sliders 71. With this configuration, the end portions 63 of the pinch roller shaft 61 are received in the respective grooves 81 of the frame 42 and are held by the frame 42 so as to be movable in the front-rear direction. In such a state, the pinch roller shaft 61 is pressed rearward toward the conveying roller 34 (i.e., toward the direction in which pressing force of the coil springs 94 act, as an example of a pressing direction) by the coil springs 94 and the pinch roller body 62 is pressed against the peripheral surface of the conveying roller 34.

The pinch roller shaft 61 has the contact surfaces 64, which may be planar surfaces, at its peripheral surface at the respective end portions 63. The pinch roller shaft 61 is disposed such that the contact surfaces 64 are oriented to the rear. This configuration may therefore provide a sufficient interval between the contact surfaces 64 of the end portions 63 of the pinch roller shaft 61 and the rear ends of the respective grooves 81. Therefore, although the pinch roller 35, i.e., the pinch roller body 62, has a relatively small outside diameter, such a configuration may enable the pinch roller body 62 to be pressed against the peripheral surface of the conveying roller 34. Consequently, this may enable the conveying roller 34 to apply a sufficient conveying force to a sheet S.

The end portions 63 of the pinch roller shaft 61 are held by the respective sliders 71 so as not to rotate relative to the sliders 71. This configuration may therefore restrict rotation and/or rattling of the pinch roller shaft 61 relative to the sliders 71 and reduce abrasion of the pinch roller shaft 61.

Each of the coil springs 94 presses the pinch roller shaft 61 between the pinch roller body 62 and either of the sliders 71. With this configuration, the pressing force or the urging force of the coil springs 94 may be applied to the portions of the pinch roller shaft 61 relatively close to the pinch roller body 62. Therefore, such a configuration may enable the pinch roller body 62 to contact the peripheral surface of the conveying roller body 52 of the conveying roller 34 with a relatively strong force, and thus enable the conveying roller 34 to apply a further sufficient conveying force to a sheet S.

The frame 42 has the first restriction surface 84 and the second restriction surface 85 that are planar surfaces extending in the front-rear direction and parallel to each other. The first restriction surface 84 faces the left slider 71 from the left, and the second restriction surface 85 faces the right slider 71 from the right. This configuration may therefore avoid the sliders 71 to tilt in the right-left direction, which may result in further avoiding the pinch roller shaft 61 of the pinch roller 35 to tilt in the right-left direction together with the sliders 71 to cause a partial contact of the pinch roller body 62 to the conveying roller body 52. Consequently, this configuration may enable the pinch roller body 62 to fully contact the conveying roller body 52 in the right-left direction and reduce uneven abrasion of the conveying roller body 52 and the pinch roller body 62. Therefore, the pinch roller body 62 may be pressed against the conveying roller body 52 with uniform force in the right-left direction, which may result in increased sheet conveying performance.

The pinch roller shaft 61 has the radius R that is greater than the distance L (e.g., the distance between the contact surface 64 and the rear end of the slider 71 in the front-rear direction).

If a pinch roller shaft has cylindrical end portions without having undergone D cutting, a distance between the center of the pinch roller shaft and the rear end of the groove 81 in the front-rear direction is not shorter than a radius of the pinch roller shaft. As opposed to this, in the illustrative embodiment, each of the end portions 63 of the pinch roller shaft 61 has undergone D cutting to have the contact surface 64. The pinch roller shaft 61 is disposed such that each contact surface 64 is oriented to the rear, that is, the rear end of the groove 81. Therefore, the distance between the center of the pinch roller shaft 61 and the rear end of the groove 81 in the front-rear direction (which corresponds to the distance L) is shorter than the radius R of the pinch roller shaft 61. Therefore, in the illustrative embodiment (e.g., the latter case), the center of the pinch roller shaft 61 may be located further to the rear than the center of the pinch roller shaft having the cylindrical end portions according to the former case Thus, although the pinch roller 35 has a relatively small outside diameter in the illustrative embodiment, such a configuration may enable the pinch roller body 62 to be pressed against the peripheral surface of the conveying roller 34. Consequently, such a configuration may enable the conveying roller 34 to apply a further sufficient conveying force to a sheet S.

In the illustrative embodiment, the pinch roller shaft 61 may be made of metal, and the frame 42 and the sliders 71 may be made of resin or plastic. If the pinch roller shaft 61 is received directly in the grooves 81 of the frame 42 without any intermediate, edges (of the contact surfaces 64) of the end portions 63 of the metal pinch roller shaft 61 may dig into the resin frame 42, which may cause unsmooth movement (e.g., rotation) of the end portions 63 of the pinch roller shaft 61 and/or damage to the frame 42. As opposed to this, in the illustrative embodiment, the end portions 63 of the metal roller shaft 61 made of metal are received in the respective sliders 71 made of resin or plastic. The frame 42 and the sliders 71 are both made of resin or plastic. This configuration may therefore allow the sliders 71 to smoothly move in the respective grooves 81 defined in the frame 42 and avoid damage to the frame 42 caused by the sliders 71.

Each of the pressed portions 67 defined between each of the end portions 63 and the pinch roller body 62 has the planar surface 68 defined further to the rear than the contact surfaces 64. This configuration may therefore avoid contact of the pressed portions 67 of the pinch roller shaft 61 to the frame 42.

The conveying roller 34, the pinch roller 35, the frame 42, and the coil springs 94 are disposed at the casing 2. Therefore, even if the urging force of each of the coil springs 94 is increased, such a configuration may reduce a tendency of the feed tray 5 to move in the direction to come out of the casing 2.

The pinch roller 35 is disposed outside the area A in which the lower end of the front cover 3 moves when the front cover 3 is opened or closed. Therefore, although the pinch roller 35 is disposed at the casing 2, the pinch roller 35 does not interfere with opening and closing of the front cover 3.

Alternative Embodiments

While the disclosure has been described in detail with reference to the specific embodiment thereof, this is merely an example, and various changes, arrangements and modifications may be applied therein without departing from the spirit and scope of the disclosure.

In other embodiments, the aspects of the disclosure may be applied to a color laser printer capable of forming a color image. In other embodiments, for example, the aspects of the disclosure may be applied to other image forming apparatuses, such as inkjet printers, which may form a color or monochrome image onto a sheet S based on image data using other image forming methods than the electrophotographic image forming method.

In other embodiments, the aspects of the disclosure may be also applied to an automatic document feeder that conveys a document sheet from a document feed tray to a document discharge tray via a reading position.

What is claimed is:

1. A sheet conveying apparatus comprising:

a conveying roller;

a pinch roller including:

a roller shaft extending parallel to a rotation axis of the conveying roller, the roller shaft including a first end portion and a second end portion opposite to the first end portion; and a roller body supported by the roller shaft and rotatable relative to the roller shaft;

a frame having a first groove receiving the first end portion of the roller shaft and a second groove receiving the second end portion of the roller shaft, the first groove and the second groove extending in a first direction orthogonal to the roller shaft, the frame holding the roller shaft movably in the first direction; and a pressing device pressing the roller shaft in a pressing direction parallel to the first direction and directed toward the conveying roller such that the roller body is pressed against a peripheral surface of the conveying roller, wherein the first end portion of the roller shaft has a first contact surface at a peripheral surface of the first end portion, the first contact surface being a planar surface, wherein the second end portion of the roller shaft has a second contact surface at a peripheral surface of the second end portion, the second contact surface being a planar surface, and wherein the roller shaft is disposed such that the first contact surface and the second contact surface are oriented in the pressing direction.

2. The sheet conveying apparatus according to claim 1, further comprising:

a first slider disposed in the first groove of the frame and movable in the first direction; and a second slider disposed in the second groove of the frame and movable in the first direction, wherein the first end portion and the second end portion of the roller shaft are held by the first slider and the second slider, respectively, such that the roller shaft is non-rotatable.

3. The sheet conveying apparatus according to claim 2, further comprising:

wherein the pressing device includes a first pressing member and a second pressing member, the first pressing member pressing a portion of the roller shaft located between the roller body and the first slider, the second pressing member pressing a portion of the roller shaft located between the roller body and the second slider.

4. The sheet conveying apparatus according to claim 2, wherein the frame includes a first restriction surface facing the first slider and a second restriction surface facing the second slider and extending parallel to the first restriction surface, and wherein the roller shaft of the pinch roller extends between the first restriction surface and the second restriction surface.

5. The sheet conveying apparatus according to claim 2, wherein the roller shaft has a radius greater in the first direction than a first distance between the first contact surface and an end of the first slider in the pressing direction.

6. The sheet conveying apparatus according to claim 2, wherein the roller shaft has a radius greater in the first direction than a second distance between the second contact surface and an end of the second slider in the pressing direction.

7. The sheet conveying apparatus according to claim 2, wherein the roller shaft is made of metal, and wherein the frame, the first slider, and the second slider are made of resin.

8. The sheet conveying apparatus according to claim 1, wherein the roller shaft includes a first shaft portion located between the first end portion and the roller body and a second shaft portion located between the second end portion and the roller body, wherein the first shaft portion has a first planar surface at a peripheral surface of the first shaft portion, the first planar surface being located further in the pressing direction than the first contact surface, and wherein the second shaft portion has a second planar surface at a peripheral surface of the second shaft portion, the second planar surface being located further in the pressing direction than the second contact surface.

9. An image forming apparatus comprising:

an image forming device configured to form an image on a sheet; and a sheet conveying device configured to convey a sheet toward the image forming device, the sheet conveying device including:

a conveying roller;

a pinch roller including:

a roller shaft extending parallel to a rotation axis of the conveying roller, the roller shaft including a first end portion and a second end portion opposite to the first end portion; and a roller body supported by the roller shaft and rotatable relative to the roller shaft;

a frame having a first groove receiving the first end portion of the roller shaft and a second groove receiving the second end portion of the roller shaft, the first groove and the second groove extending in a first direction orthogonal to the roller shaft, the frame holding the roller shaft movably in the first direction; and a pressing device pressing the roller shaft in a pressing direction parallel to the first direction and directed toward the conveying roller such that the roller body is pressed against a peripheral surface of the conveying roller, wherein the first end portion of the roller shaft has a first contact surface at a peripheral surface of the first end portion, the first contact surface being a planar surface, wherein the second end portion of the roller shaft has a second contact surface at a peripheral surface of the second end portion, the second contact surface being a planar surface, and wherein the roller shaft is disposed such that the first contact surface and the second contact surface are oriented in the pressing direction.

10. The image forming apparatus according to claim 9, further comprising:

a casing; and a tray detachable from the casing and configured to support a sheet, wherein the image forming device and the sheet conveying device are disposed at the casing.

11. The image forming apparatus according to claim 10, further comprising a cover pivotable between an open position at which the cover is angled relative to one of sides of the casing and a closed position at which the cover extends along the one of sides of the casing, wherein the pinch roller is disposed outside an area of the casing in which a part of the cover moves when the cover pivots between the open position and the closed position.

12. The image forming apparatus according to claim 11, wherein the first contact surface and the second contact surface face away from the one of sides of the casing.

* * * * *